United States Patent [19]

Maier

[11] 4,273,089

[45] Jun. 16, 1981

[54] OPEN LOOP COMPUTER-CONTROLLED SPARK IGNITION TIMING SYSTEM

[75] Inventor: Thomas A. Maier, Apollo, Pa.

[73] Assignee: Essex Group, Inc., Fort Wayne, Ind.

[21] Appl. No.: 74,614

[22] Filed: Sep. 12, 1979

[51] Int. Cl.[3] ..... F02P 5/04

[52] U.S. Cl. ..... 123/417; 123/416

[58] Field of Search ..... 123/117 D, 117 R, 32 EB, 123/417, 416

[56] References Cited

U.S. PATENT DOCUMENTS

| | | | |
|---|---|---|---|
| 3,941,103 | 3/1976 | Hartig | 123/117 D |
| 3,946,709 | 3/1976 | Monpetit | 123/117 D |
| 4,175,507 | 11/1979 | Kawai | 123/117 D |

*Primary Examiner*—Ronald B. Cox

*Attorney, Agent, or Firm*—M. P. Williams

[57] ABSTRACT

An electronic system for controlling the firing time of a spark ignition, internal combustion engine counts teeth or other code indicia as an angle-related, closed-loop, coarse indication of firing angle and follows the coarse indicating count with a fine, variable open-ended time delay in response to clock signals currently related to engine angle, to provide firing angles which fall within a tooth (or other indicium). In one embodiment, a pre-dwell period of fixed angular extent, determined by a fixed tooth count, is followed by a variable dwell period including a variable tooth count portion, a fixed speed measurement and calculation time portion, and a variable, final clock time-out portion. In the disclosed embodiment, the system is controlled and calculations are performed by a microprocessor, whereas tooth counting, tooth-to-tooth clock calibration and clock counting are performed by a hardware counter which is controlled by hardware logic circuitry.

4 Claims, 4 Drawing Figures

OPEN LOOP COMPUTER-CONTROLLED SPARK IGNITION TIMING SYSTEM

DESCRIPTION

1. Technical Field

This invention relates to electronic controls for controlling the firing angle of spark ignition, internal combustion engines.

2. Background Art

In spark ignition, internal combustion engines, it has long been known to adjust the timing of the spark ignition as a function of speed and as a function of engine loading. The speed function has typically been provided by centrifugal weight distributor advance, and the load function has typically been provided by intake manifold vacuum advance to the distributor. Both of these functions are capable of providing only an additive, monotonic input to the advancement of the spark. That is, the spark easily is advanced as a function of increased speed; similarly, the spark easily is advanced as a function of increased intake manifold vauum.

With the growing concern over exhaust emission pollutants, empirical determination of optimal engine operating parameters, only one of which is firing angle, has shown that the optimum firing angle for minimum pollution as a function of speed is not independent of engine load, nor is the optimum firing angle for minimum pollution as a function of engine load (or vacuum) independent of speed. In fact, optimum angle is not simply an increasing advance in the firing angle with increasing speed and/or vacuum. To the contrary, the functions are quite complex and diatonic or triatonic in any cross section of vacuum as a function of speed or speed as a function of vacuum. Stated alternatively, there are multiple maxima and minima in the topography of the complex speed/engine load (vacuum) characteristics required for minimal pollutants in the exhaust emissions.

In order to accommodate this complex, interrelated control of firing angle as a dependent function of both speed and engine loading, the traditional mechanical vacuum and centrifugal weight advances of the distributor have been eliminated in favor of electronic controls. Generally, production vehicles using electronic controls at this time typically include a digital microprocessor which responds to values of intake manifold absolute pressure to calculate, or otherwise provide, unique values of firing angle for each unique combination of speed and manifold pressure. In some of these systems, the variable desired firing angle may be altered by other parameters, such as engine coolant temperature.

In some of the electronic firing angle calculators, the speed input is provided by means of a phase locked loop which is synchronized to the crank shaft of the engine by one means or another, thereby to provide a clock having a fixed number of pulses during each cylinder sub-cycle of an engine cycle. Such an arrangement provides clock signals which have a definite angular revolution relationship. However, devices of this type have been found to be inadequate since the phase locked loop requires at least a cycle to determine a change has been made, and may variously require one or several additional cycles in order to correct for the change in engine speed. During periods of rapid acceleration and deceleration, which are the occasions in which exhaust pollutants may be the highest, this system performs the least well. Additionally, in systems of this type, a substantial fraction of the cost and vulnerability to damage arises in the use of a microprocessor and a random access memory, together with a rather complex power supply required in order to service the processor and the RAM.

Because of this, attempts have been made to provide simplified electronic systems which do not use a programmable microprocessor, but dedicated hardware to achieve the accomplishment of a complex, desired firing angle. Examples are U.S. Pat. Nos. 4,018,197, 4,036,190 and 4,963,539. In some cases, the simplified devices have fallen short of the mark because they simply add firing angle factors determined from speed to firing angle factors determined from manifold absolute pressure, and therefore are incapable of providing the complex profiles required. In a sense, these are simply electronic variations on the old flyweight and vacuum advance techniques known to the prior art. In one such circuit, the engine crank shaft angle is recognized only on a cylinder by cylinder basis, speed is measured during one period and utilized during a subsequent period. Therefore, this system is also unresponsive during rapid acceleration and deceleration, which are typically accompanied by a high degree of pollutant in the exhaust emissions. In other simplified devices, the resolution of change in firing angle as a function of manifold pressure and/or speed may be too gross to accommodate the necessary complex profile for minimizing pollutants in exhaust emissions. In still others, the duplicate use of hardware results in an inherent cyclic delay which is undesirable as described hereinbefore with respect to the phase locked loop.

DISCLOSURE OF THE INVENTION

Objects of the invention include provision of improved apparatus for electronically controlling the firing angle of spark ignition, internal combustion engines with a complex profile dependent upon mutually related speed and engine loading.

According to the present invention, in electronic apparatus which counts indications of sub-cyclic angular revolution of an engine to provide a coarse firing angle indication and counts a variable number of clock signals to provide a final, fine indication of the desired firing angle, the counting of angle-related indicia is divided into a fixed angle, pre-dwell period in which the total number of required indicia is calculated while a fixed number of indicia are counted, followed by a variable angle portion of a dwell period in which a variable number of indicia are counted. The dwell period thus may contain a variable number of angle-related indicia and a variable number of final clock signals. In further accord with the invention, the clock signals are related to desired firing angle at the present speed of the engine by a count of clock signals between adjacent sub-cyclic angle indicia, just prior to the final clock signal count. In still further accord with the present invention, the final clock signal count takes into account the engine angle consumed during the speed-relating clock count and the time consumed for final calculations.

The invention provides accurate dwell angle which rapidly follows changes in engine operation, while permitting use of a relatively low cost microprocessor.

The foregoing and other objects, features and advantages of the present invention will become more apparent from the following detailed description of a preferred embodiment thereof, as illustrated in the accompanying drawing.

BRIEF DESCRIPTION OF THE DRAWING

FIG. 2 is a series of timing indications on a common engine angle base, illustrating operation of the present invention;

BEST MODE FOR CARRYING OUT THE INVENTION

Figure 1:
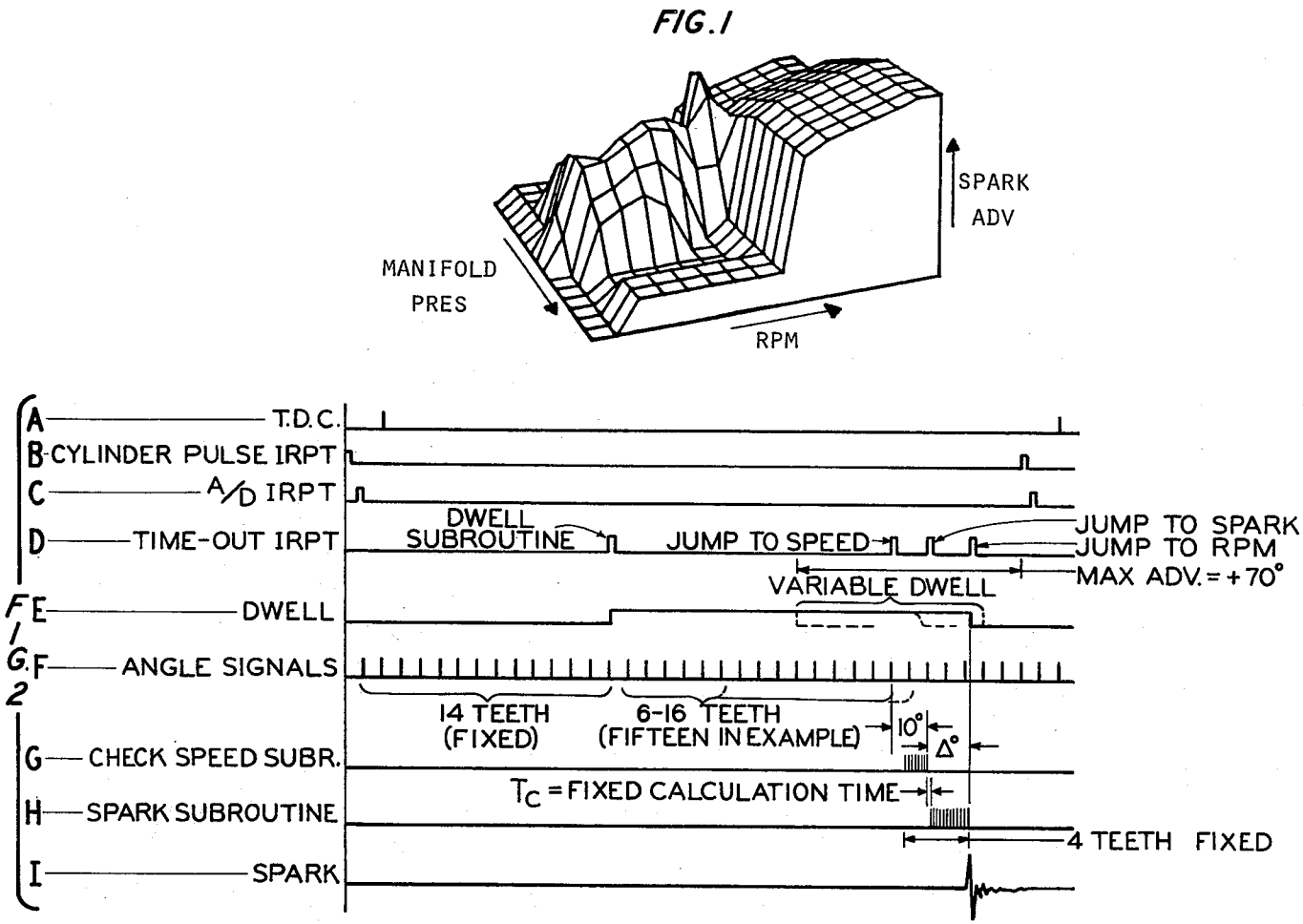
FIG. 1 is an illustration of desired firing angle as a complex function of both speed and intake manifold pressure.

As preferred to briefly hereinbefore, optimum spark firing angle in a spark ignition, internal combustion engine, to provide for minimal pollutants in the exhaust emissions of the engine, is a very complex function of both speed and engine loading. The engine loading is typically manifested by intake manifold pressure (which may be monitored either as an absolute pressure above zero or as a relative vacuum below atmospheric pressure). FIG. 1 illustrates, in a manner related to, but simplified from, an actual complex firing angle relationship to speed and engine load, which has been determined empirically. FIG. 1 is illustrative of the fact that modern firing angle control circuits cannot simply increase the advance of the firing angle as a function of increases in speed and as a function of decrease in manifold pressure.

The present embodiment is disclosed as being useful with a four cylinder, four stroke engine, in which engine angle signals are derived every half revolution from protuberances on the flywheel, said flywheel having seventy-two teeth, thereby providing thirty-six tooth signals in each cylinder-related sub-cycle (each half revolution) of the engine.

FIG. 2-A illustrates the occurrence of top dead center for two successive cylinders of an engine. As is known in the art, most engines will operate utilizing a fixed advance of +10°, and circuitry is sometimes provided to provide for such operation as an emergency backup in the event that the regular timing advance circuitry fails. In order for the embodiment of the invention to be compatible with such backup systems if desired (which form no part of the invention and are not shown herein), the embodiment herein utilizes a basic cylinder timing signal which is taken 10° before top dead center, as is illustrated in FIG. 2-B. The cylinder pulse initiates operation of a firing cycle which commences with starting an analog to digital conversion, to provide inlet manifold pressure in a digital format, the completion of which causes an A/D interrupt as illustrated in FIG. 2-C.

The cylinder pulse interrupt (FIG. 2-B) also enables a tooth counter to begin counting teeth with the next tooth to be sensed, as is illustrated in FIG. 2-F. Fourteen teeth are counted off to provide for a major, fixed portion of delay required to delay from 10° in advance of one TDC to the required number of degrees of advance of a subsequent TDC to which the actual angle of firing of the spark relates. When the A/D interrupt is sensed, a read only memory is interrogated using a previously stored RPM value (which is derived near the end of the preceding cycle as is described with respect to this cycle hereinafter), and the digital value of manifold absolute pressure derived from the analog/digital conversion. The value read from the ROM is manipulated in a manner described hereinafter to determine the amount of delay following the counting of fourteen teeth which is necessary in order to have the spark fire at the desired engine angle, and various factors related thereto. The fourteen-tooth, fixed pre-dwell interval (FIG. 2-F), is used to ensure that, even at the highest speeds of the engine (where the 5° angles take very little time), there is an adequate period of time for these calculations to occur, as is described hereinafter. When the fixed pre-dwell interval represented by fourteen teeth has been completed, a time-out interrupt (FIG. 2-D) occurs; in an interrupt service routine described hereinafter, the first of these is determined to start a dwell subroutine, which is a subroutine in which an integral number of additional teeth are counted off, as is determined by the calculated performed during the pre-dwell period (the fourteen-tooth period, FIG. 2-F). In the example illustrated in FIG. 2 and described elsewhere, it is assumed that the speed of the engine and its loading are such as to require a spark angle of +23°. In such a case, this results in fifteen teeth being counted, followed by a speed check (FIG. 2-G) in which the number of clock pulses within a 5° tooth angle increment is determined, followed by a fixed calculation time (FIGS. 2-G, -H) followed by an integral number of clock pulses determined by the desired angle at the current speed of the engine, at which time the dwell period ends and the spark occurs (FIG. 2-J).

The pervasive aspect of the present invention is that it provides for counting off the delay necessary from a previous cylinder pulse to a desired firing angle largely in terms of angular increments represented by signals sensed directly in response to the rotation of the crank shaft (such as the tooth signals, FIG. 2-F) and providing for vernier or fine delay, controlled by means of clock signals, in an open ended fashion, after counting off a sufficient number of teeth. The invention provides more than the minimum, sub-tooth vernier number of clock signals, however, in the sense of accommodating a fixed calculation time which may consume variable amounts of engine angle depending upon engine speed. Thus in the example shown in FIG. 2, a 23° advance angle is accommodated with a delay from 10° before TDC consisting of 70° of fixed delay (the fourteen-tooth count), 75° of variable delay by counting fifteen teeth in the present case, 10° to permit a tooth-to-tooth clock count (FIG. 2-G) and 12° of a continued variable tooth count (FIG. 2-H) and a fixed calculation time (which varies in engine degrees with engine speed) following the tooth-to-tooth clock count of the check speed subroutine.

Figure 3:
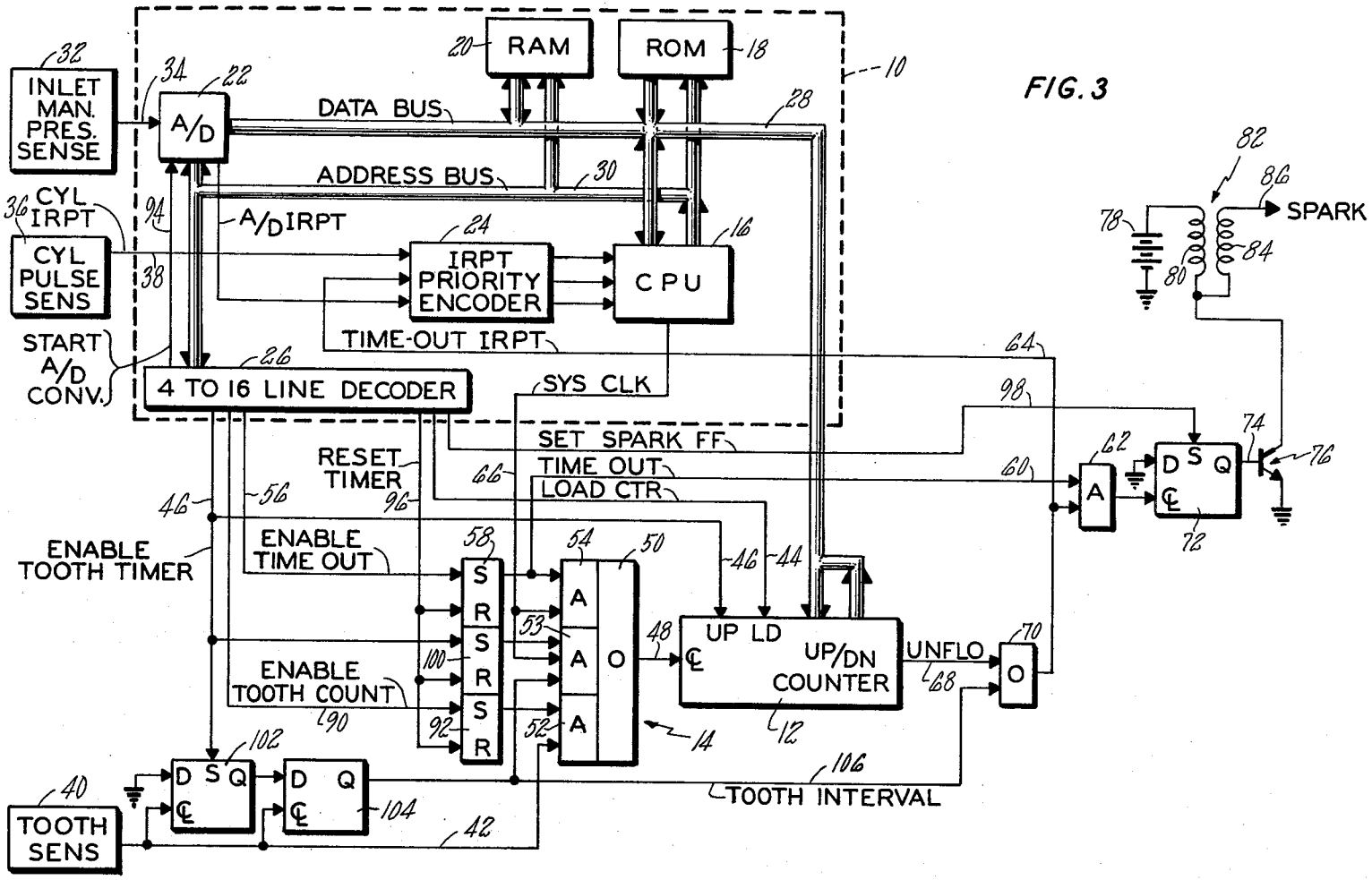
FIG. 3 is a simplified schematic block diagram of a preferred embodiment of the invention.

Referring now to FIG. 3, a preferred embodiment of the invention utilizes a microcomputer 10 which controls a hardware counter 12 and logic circuits 14. The microprocessor 10 may, for instance, be of a configuration employing readily available digital chips configured in a normal fashion. For instance, the microprocessor 10 may comprise: a CPU 16 (such as a TI 9981); a read only memory (ROM) 18 (such as an INTEL 2716); a random access memory (RAM) 20 (such as an INTEL 2114); an analog to digital converter (A/D) 22 (such as a Burr-Brown ADC 80-Z); an interrupt priority decoder 24 (such as a TI 74148); an operational address decoder 26, which may comprise a four-to-sixteen line decoder (such as a TI 74154); and circuitry to provide interconnections including a data bus 28 and an address bus 30, together with other interconnections and input and output ports as illustrated in FIG. 3.

The engine loading is determined by sensing inlet manifold pressure by means of a sensor or transducer 32 which provides an analog indication of inlet manifold pressure on a line 34 as an input to the A/D converter 22. A cylinder pulse sensor 36 may comprise a magnetic reluctance sensor or other suitable sensor capable of sensing either protuberances or other indicia (e.g. magnetic) at the desired relationship with respect to each cylinder-related sub-cycle of engine revolution, to provide a cylinder interrupt input signal on a line 38. A tooth sensor 40 may comprise a magnetic reluctance sensor disposed to sense the passage of flywheel teeth, or it may comprise any suitable sensor corresponding to a suitable number of indicia rotating with the flywheel of the engine, to provide many angle-related pulses in each cylinder-related sub-cycle of engine revolution. Since the present invention has particular utility with respect to indicia representative of relatively large angles (such as 5°) compared to the accuracy (such as a fraction of a degree) with which spark firing angle is to be determined, the invention may be practiced to advantage when sensing flywheel teeth. The tooth sensor 40 provides tooth signals on a line 42 which are utilized both for gross angle determination and for speed determination in which the number, N, of system clock signals which appear between adjacent teeth, provide an indication of rotational speed of the engine, all as is described more fully hereinafter.

The hardware counter 12 is, in this embodiment, an up/down counter which is presettable to a given amount in response to signals on the data bus 28 in the presence of a load counter signal on a line 44 which is provided by software through the address bus 30 and the decoder 26. The counter 12 is shown in FIG. 3 to be normally set for counting down, but to be commandable to count up in response to an enable tooth timer signal on a line 46 which is provided by software over the address bus 30 and the decoder 26. The counter advances its count (in either the up direction or the down direction, in dependence upon the presence or absence of the signal on the line 46, respectively) in response to clock signals on a line 48 which are provided by an OR circuit 50 in response to any one of three AND circuits 52–54.

Referring now to the PROGRAM LISTING, to FIG. 2, and to FIG. 3, decimaled numbers in parentheses (e.g. 1.1) in the following description refer to corresponding statements of the PROGRAM LISTING. When the system is first started up, the CPU 16 performs an initialization routine which begins (1.1) with disabling interrupts to prevent the system from responding to cylinder pulse signals on the line 38 while it is in initialization, and to permit assurance that a time-out interrupt can be utilized in a time-out operation to initialize the spark flip-flop to zero at start. This is achieved by loading the counter with a one (1.2) and providing (1.3) the enable time-out signal on a line 56 so as to set a latch 58, the output of which is a time-out signal on a line 60. This renders an AND circuit 62 sensitive to a time-out interrupt on a line 64, and enables the gate 54 to pass system clock signals on a line 66 through the AND circuit 54, the OR circuit 50 to clock the counter 12 causing it to count down from one to zero. This produces an underflow signal on a line 68 which operates an OR circuit 70 to generate the time-out interrupt signal on the line 64. Since interrupts are disabled at this time, no interrupt action is permitted. But the interrupt signal on the line 64 passes through the AND circuit 62 and clocks a D-type flip-flop 72, the control input of which is at a low logic level (grounded), ensuring that the flip-flop 72 will be in the reset state. This ensures that there is no signal at the Q output of the flip-flop on a line 74 so that a transistor 76 will not conduct current from battery 78 through the primary 80 of the high voltage coil (or transformer) 82. When the transistor 76 is in operation (as described later), current passes through the primary 80 through the transistor 76 to ground. This is called the "dwell period" as is well known in the art. When the transistor 76 is cut off, the collapse of current flow in the primary induces a large voltage in the secondary 84 so as to generate a very high voltage signal which is distributed to the spark plugs from a high voltage line 86.

When the time-out (1.3) is complete, the latch 54 is reset by the next step (1.4), by means of a reset timer signal on a line 88. And to assure initialization in the counter, it is loaded with zero (1.5) on the data bus 28 in response to a load counter signal on the line 44. Initialization now being basically complete, the interrupts are enabled (1.6) and the CPU sits in an idle loop waiting for further interrupts (1.7).

At the start of the next cylinder-related sub-cycle of the engine, a cylinder pulse interrupt (FIG. 2-B) is provided by the cylinder pulse sensor 36 on the cylinder interrupt line 38. This is decoded by the interrupt priority decoder 24 to the cylinder pulse interrupt service routine, which commences (2.1) by loading the counter with a number on the data bus 28 which is equal to some fixed number of degrees of engine angle which are to be dissipated in a pre-dwell period, such as fourteen teeth which are equivalent to 70° (at 5° per tooth), in response to a load counter signal on a line 44 which is provided by the decoder 26 from the address bus 30. Counting down of this number of teeth is initiated (2.2) by providing an enable tooth count signal on a line 90 which sets a latch 92 to enable the AND circuit 52 to be responsive to tooth signals on the line 42, so the OR circuit 50 will provide signals on the line 48 to the clock input of the up/down counter 12, so that counting down of the fixed number of teeth commences immediately. In the next step (2.3), the decoder 26 provides a start A/D conversion signal on a line 94, to cause the A/D converter 22 to convert the analog signal from the pressure sensor 32 on the line 34 to a digital number representative of the manifold inlet pressure.

Then (2.4), the processor waits for an A/D interrupt. When this occurs (FIG. 2-C), the A/D interrupt service routine commences (3.1) by reading the output of the A/D converter 22 over the data bus to the RAM 20. Next (3.2) a desired firing angle value is read from the table in ROM in response to values of the manifold absolute pressure and current RPM (which is described more fully hereinafter) provided to the address bus 30 by the CPU 16. This is a value for optimum firing angle (which, for simplicity of understanding in the present embodiment is considered to be the number of degrees in advance of cylinder top dead center at which the spark is to occur for optimum engine operating conditions). If the ROM cannot handle the number of desired data points of firing angle, interpolation or other techniques may be used to increase the resolution as necessary. This is irrelevant to the invention. The remainder of the A/D interrupt service routine involves calculations in the processor employing the CPU to prepare for subsequent routines involving the use of the desired spark angle. This processing occurs very quickly but is performed in parallel with the fixed counting of teeth which continues during the A/D interrupt routine which extends until the commencement of the dwell subroutine in response to the next time-out interrupt (FIGS. 2-C, -D). Since the spark is determined by delay from a cylinder pulse (FIG. 2-B) but is expressed in terms of advance from the next top dead center (FIG. 2-A), the first step in the process (3.3) is to subtract the desired angle from the total expense of 190° from one cylinder pulse (10° before TDC) to the following TDC. Then, the integral number of teeth in the remainder is determined by dividing by 5° per tooth (3.4) and the remainder (in degrees) is stored. This is referred to in further calculations as "delta DEG". Since fourteen teeth are utilized in a fixed pre-dwell interval, these fourteen teeth are part of the integral number of teeth determined in step (3.4). Additionally, a period of time equal to angular revolution of the engine equivalent to four teeth (just prior to the occurrence of the spark, FIGS. 2-G, -H) is set aside for a speed check and processor calculations that must be performed just prior to the end of the dwell period. Since these calculations are done on a time base dependent upon system clock, and involve both angular increments and fixed calculation time increments, sufficient engine angle displacement has to be reserved so that at the highest speed of the engine there is adequate time to make the desired calculations. For that reason an additional four teeth of angular revolution are set aside. This makes a total of eighteen teeth (fourteen fixed teeth, FIG. 2-F and four teeth of fixed calculation time, FIGS. 2-G, -H) which are subtracted in step (3.5) from the total number of teeth determined in step (3.4). The result is stored (3.6) as a coarse delay angle expressed as a number of teeth, which in the present example of a desired spark firing angle of +23°, is equal to fifteen teeth. This number can vary, however, between six and sixteen teeth (FIG. 2-F) for dwell angles which vary, respectively, from a maximum advance of +70° to a minimum advance of +15°.

TABLE OF EQUATIONS

| | |
|---|---|
| Equation 1 | $\omega = \frac{5°}{N} \times f = \frac{5°}{N} \times \frac{2 \times 10^6}{sec}$ |
| Equation 2 | $\theta = 10° + \Delta\ DEG$ |
| Equation 3 | $\omega = \frac{\theta}{T}$ so $T = \frac{\theta}{\omega}$ |
| Equation 4 | $T = \frac{10° + \Delta\ DEG}{5°} \times \frac{Nsec}{2 \times 10^6}$ |

To prepare for finding the correct number of clock counts to be provided after the accumulated angular revolutions expressed by a fixed count of fourteen teeth, a coarse count of delay angle (six-sixteen teeth) and the equivalent of four teeth for speed measurement and calculation time, the nature of these calculations must be considered. Referring to the Table of Equations hereinafter, the speed is measured (FIG. 2-G) by determining the number of clock pulses which appear between two consecutive teeth, an expanse of 5°. Therefore, Equation 1 shows that the engine angular speed is equal to 5° per number of counts times the frequency of the system clock, which in this case is 2 megahertz. The angle (FIGS. 2-G, -H) which is to be timed is equal to 10° (to make the speed measurement) plus delta degrees (the angle between the end of the speed calculation and the desired firing angle). By relating the speed and the angle in accordance with the known relationships of Equation 3, Equation 4 shows that the desired time of firing includes a factor of 10°+delta DEG divided by 5°. This is achieved in steps (3.7) through (3.10). And then, the processor waits for a time-out interrupt, which will be the time when the fixed pre-dewll period equal to fourteen teeth is completed (FIG. 2-F).

Upon the occurrence of the first time-out interrupt (FIG. 2-D) the latch 92 is immediately reset by a reset timer signal provided on a line 96 by the decoder 26 in step (4.1). Steps (4.2)-(4.4) determine that none of the "done" flags have been set so that no jumps occur. This causes the time-out interrupt to result in the dwell subroutine which is principally concerned with counting the variable number of teeth (fifteen in the example herein, FIG. 2-F) of the coarse delay angle. As a first step, the counter 12 is loaded with the coarse delay angle, which in this case is the number 15 (indicating fifteen teeth of angular engine rotation delay), which is provided on the data bus 28 and caused to be loaded into the counter by a load counter signal on the line 44. Then, an enable tooth count signal on the line 90 again sets the latch 92 so that the AND circuit 52 will gate tooth signals on the line 42 through the OR circuit 50 and over the clock input line 48 to step the counter 12 downward. The fact that the dwell subroutine is in process is manifested (5.3) by setting the dwell done flag, and the dwell period is actually commenced (5.4) by providing a signal on a line 98 from the decoder 26 that forces the spark flip-flop 72 into the set state. This provides a signal on a line 74 which causes current flow through the transistor 76 and the primary 80, in the normal fashion. The current builds up during the dwell period, and the spark will be generated in response to high voltage on the line 86 by interrupting the current in the primary 80, as is described with respect to the spark subroutine hereinafter. When these tasks have been performed, the processor simply waits out the time that it takes to count the variable number of teeth (fifteen in this example, FIG. 2-F) which are indicative of the coarse delay angle portion of the dwell period.

When the requisite number of teeth have been counted, a time-out interrupt again appears by means of the overflow of the counter 68 causing the OR circuit 70 to generate the time-out interrupt signal on the line 64. This causes (4.1) the latch 92 to again be reset so as to block any further counting of teeth through the AND circuit 52. In steps (4.2) and (4.3) it is determined that neither the spark nor the speed check "done" flags have been set; in test (4.4) it is determined that that dwell done flag was set in step (5.3) so that the program jumps to instruction (6.1) of the speed check subroutine. This clears the counter 12 by providing all zeros on the data bus 28 concurrently with a load counter signal on a line 44. Next, the counting of tooth-to-tooth clock signals (FIG. 2-G) is initiated (6.2) by providing the enable tooth timer signal on the line 46 to set a latch 100, to force the counter into an up count state, and to initiate operation of a one-and-only-one circuit by forcing a D flip-flop 102 into the set state. The very next tooth signal on the line 42 provides a clock input to another D-type flip-flop 104, which has been enabled by the Q output of the flip-flop 102. This first tooth signal also clocks the flip-flop 102, and since its D input at logic zero (illustrated for simplicity herein as ground), this causes the flip-flop 102 to assume the reset state so that the signal is no longer present at its Q output. The flip-flop 104 produces a tooth interval signal on a line 106 which is also applied to the AND circuit 53. This causes system clock signals on the line 66 to immediately pass through the AND circuit 53 so that the OR circuit 50 provides system clock signals on the clock input line 48 to the counter 12, so that the counter will count from zero upwardly as long as the AND circuit 53 continues to gate system clock signals through it.

As the counter is counting clock signals during a tooth interval, instruction (6.3) clears the dwell done flag and instruction (6.4) sets the speed check done flag to indicate that the speed check routine has been processed. And then, instruction (6.5) causes the processor to wait for the next time-out interrupt. The very next tooth signal on the line 42 has no affect on the flip-flop 102, since it has been reset and it has a low logic input, but it will cause resetting of the flip-flop 104 so that the signal 106 will disappear, therby blocking the AND circuit 53 so that no further clock signals are passed to the counter 12. The signal on the line 106 disappearing provides a negative level shift which causes the OR circuit 70 to generate a time-out interrupt on the line 64. This is not carefully illustrated in FIG. 3, since it is dependent upon the particular circuits which are employed and the utilization of positive and/or negative inputs and level shifts, all as is well known in the art. The generation of the time-out interrupt on the line 64 as a consequence of disappearance of the tooth interval signal on the line 106 causes (4.1) the latch 100 to be reset. Instruction (4.2) determines that the spark done flag is not set, but instruction (4.3) determines that the speed check done flag was set in instruction (6.4) so that the time-out interrupt service routine jumps to the spark subroutine at instruction (7.1).

In the spark subroutine, instruction (7.1) causes the count, N, of system clocks which appeared in a tooth-to-tooth interval to be read from the counter into RAM 20. Then, the time-out angle which is determined in step (3.9) and stored in step (3.10) is multiplied by the number of counts (N) in step (7.2). This is in accordance with Equation 4 as described hereinbefore. For greater precision, rescaling may be employed as indicated in step (7.3). As seen in FIG. 2-G and -H, the fixed calculation time of the spark subroutine elapses before counting of system clock signals can commence to determine the exact final firing angle, in an open ended fashion, in accordance with the invention. This time is determined either empirically or through design considerations and may be on the order of several hundred microseconds. At very slow engine speeds, this time may be insignificant; but at very high speeds, it can consume a significant angle, and should be included in the angle considerations. Therefore, step (7.4) deducts the fixed calculation time from the remaining time to the exact firing angle. The result is loaded (7.4) into the counter 12 over the data bus 28 concurrently with a load counter signal on the line 44. Then, a time-out signal is generated on the line 56 to set the latch 58 to enable the AND circuit 54 to pass system clock signals on a line 66 through the OR circuit 50 and over the clock input line 48 to the counter 12, so that the counter can count down the remaining time by system clock signals. This is illustrated in FIG. 2-H. During this countdown, instruction (7.8) sets the spark done flag to indicate that the spark subroutine is being processed.

Then, in instruction (7.9) the processor waits for a subsequent time-out interrupt, which will signal the end of the dwell period and cause the spark flip-flop to be cleared and create the spark. This occurs as a consequence of the counter 12 providing an underflow signal on the line 68 which passes through the OR circuit 70 to generate the time-out interrupt signal on the line 64. Since the latch 58 is set, the time-out signal will appear on the line 60 so that the AND circuit 62 can provide a clock signal to the flip-flop 72. Because of the fact that the flip-flop 72 has its logic input set to logic zero (illustrated herein by ground) the clock signal will cause the flip-flop 72 to become reset so that the Q output signal on the line 74 will disappear, and the transistor 76 will cease conducting. Collapse of current in the primary 80 will induce a high voltage in the secondary 84 to provide a spark inducing signal on the high voltage line 86, in the known manner. It is the underflow at the end of counting of a requisite number of system clock signals, which produces an interrupt, which together with the time-out signal, shuts off current to the primary thus producing the spark at the desired time.

The interrupt on the line 64 also causes repeating of the interrupt service routine so that the latch 58 is reset by a reset timer signal on the line 96 (4.1). Instruction (4.2) determines that the spark done flag has been set, so that the program advances to the RPM subroutine. The first step (8.1) in the RPM subroutine clears the spark done flag so that, in a subsequent cycle of operation, the first time-out interrupt will be recognized as initiating the dwell subroutine in the manner described hereinbefore. In order to determine present speed, a factor which relates the frequency and the number of teeth on the flywheel (or other indicia per revolution of the engine), which in the present example would include 10 megahertz and seventy-two teeth, is divided by N (the number of clocks determined in the check speed subroutine (FIG. 2-G).

Figure 4:
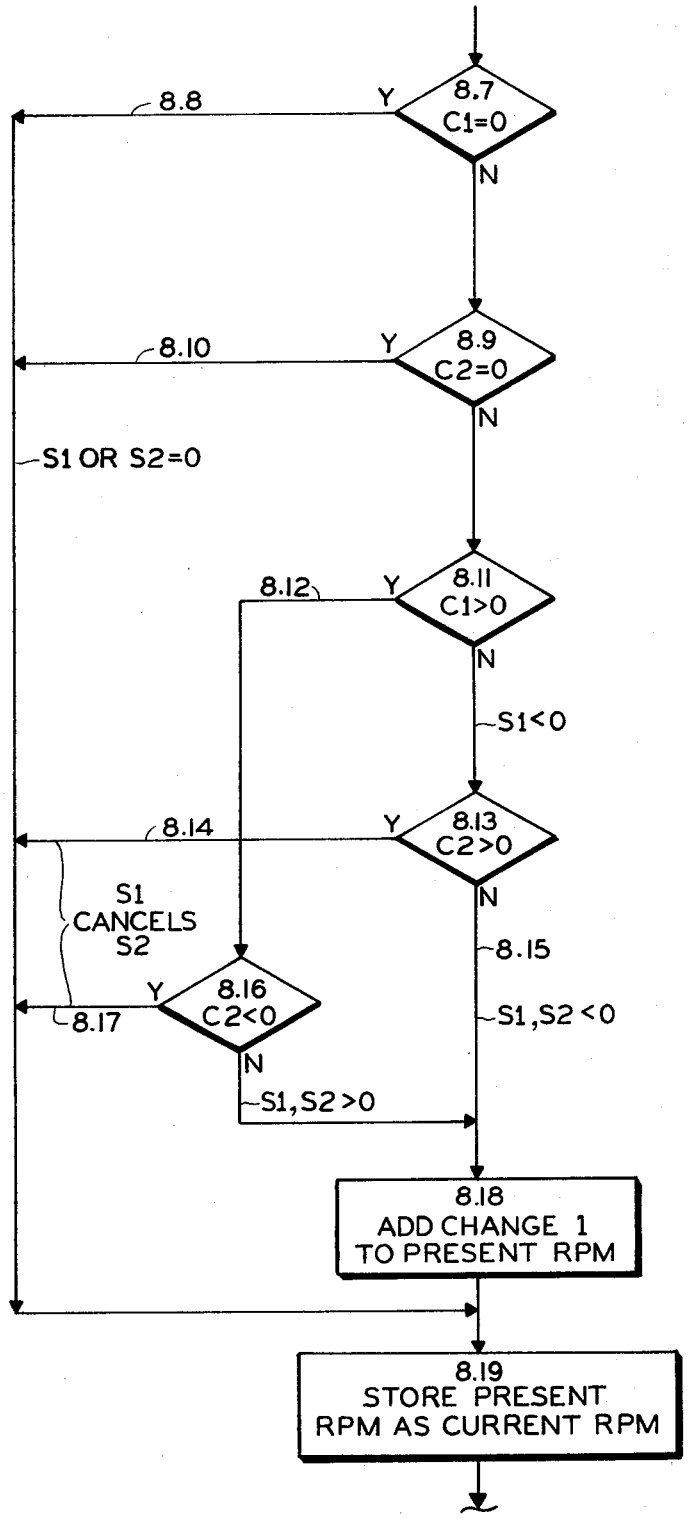
FIG. 4 is a simplified logic diagram illustrative of a portion of the instruction listing related to the embodiment of FIG. 3.

In instruction (3.2) the desired angle was determined from ROM in dependence upon a value of current RPM. If desired, the result of step (8.2) can be used as that value of current RPM. However, in operation of the engine which involves high rates of acceleration or high rates of deceleration, the RPM may vary sufficiently from the check speed subroutine of one cycle (FIG. 2-G) to the A/D interrupt of a subsequent cycle (FIG. 2-C), immediately following which the value of RPM determined from the previous check speed subroutine is utilized for lookup of the current angle in the ROM. Naturally, the variation in speed which can occur is a function of the firing angle, since the value of N is determined near the end of the dwell period (within four teeth thereof in every case). Thus, when the firing angle is highly advanced there is a greater delay before utilization of N in the RPM addressing of ROM, whereas when the spark is not advanced very much, the change in speed as a consequence of acceleration or deceleration will be much less before the next A/D interrupt. Therefore, the invention may be practiced by utilizing present RPM determined in step (8.2) as the value of current RPM to be utilized in step (3.2). On the other hand, anticipation of changes in RPM may be accommodated by utilizing the extrapolation routine of instructions (8.3) through (8.21) if desired. In instruction (8.3) the last determined present RPM value is fetched, and in instruction (8.4) the next to last present RPM is fetched. In instruction (8.5) the difference between the present RPM and the last RPM is determined, and this is referred to as "change 1"; in step (8.6) the difference between the last RPM and the next to last RPM is determined, and this is referred to as "change 2". Instructions (8.7) through (8.19) determine if change 1 and change 2 are both non-zero in the same direction, and if so, cause change 1 to be added to the present RPM in order to provide the current RPM, which is an extrapolated value used only for addressing ROM in the next cycle, the present RPM being retained for use as the last RPM in the next cycle. This is diagramed in the flowchart to FIG. 4 in which "C" denotes change, and each test or branch is identified with a corresponding instruction: thus the first test (8.7) may result in the branch of instruction (8.8) as indicated in FIG. 4. Further, the conditions indicated at the various steps of the program are shown in FIG. 4, and therefore these instructions are not described further. After current RPM is determined (with or without having a change added to it) the next to last RPM is thrown away and is replaced with last RPM, and last RPM is replaced with present RPM, to be ready for execution of the same program in the next cylinder-related sub-cycle of the system. Then, in instruction (8.22) the processor goes into a wait mode until the next cylinder pulse interrupt is detected, and the entire process beginning at step (2.1) is repeated for the next cylinder in the sequence.

As another alternative in the implementation, the speed check subroutine may be performed at the start of each cylinder-related sub-cycle, as the count of the first two of the fourteen teeth, to provide a more up-to-date value of N, followed by the RPM routine as the first portion of the A/D interrupt routine. This may be done in any case where processor speed is adequate at the highest engine speed. And, they may be done in lieu of the check speed subroutine that follows the variable tooth count of the dwell period (FIG. 2-G); or it may be done in addition to it, thereby providing updated speed information twice for each cycle. In such cases, the RPM subroutine would not be performed following the spark subroutine, and the extrapolation of RPM, as in steps (8.7)-(8.18) would be eliminated.

Reference to FIG. 2-F, -G and -H illustrate the basic principle of the present invention, which is determining the correct delay for institution of spark firing angle by means of a coarse monitoring of engine angle itself, in the angle domain (by monitoring signals indicative of flywheel teeth or equivalent indicia which are rotating with the crank shaft of the engine), which is continued to the end of the speed check subroutine (FIG. 2-G), following which accurately-timed, open-loop operation counts off the remaining angle-equivalent in the time domain, for angular duration of less than three teeth, to provide a firing angle which may fall within a fraction of a tooth.

In the embodiment illustrated in FIG. 3, a hardware counter and dedicated logic circuits are utilized. However, reference to FIG. 2 shows that if a suitable processor were employed, capable of operation at higher speed and with more program and data storage capability, it would be possible to utilize the CPU 16 for the counting functions, employing tooth signal-induced interrupts which would cause the processor to sense and count the teeth by means of interrupt handling, the processor otherwise performing the simple calculations of the A/D interrupt service routine and the spark subroutine as a background job between tooth-induced interrupts, or as a program set within such interrupts. The tooth-induced interrupts would be of a lower priority than the time-out interrupts, since it would be essential in the fixed pre-dwell plus variable dwell scheme of the present embodiment to sense the different functions to be performed as described hereinbefore. Alternatively, since the tooth counting of the pre-dwell period of the A/D interrupt, and tooth counting of the dwell subroutine compete only with the processing of the A/D interrupt service routine, it is entirely feasible that the hardware counter may be eliminated, and the processor program perform the tooth and clock counting functions internally, within the concept of the present invention.

In order for the invention to provide very accurate, open-ended, time-domain counting of clock signals to make the final variable determination of precise firing angle, the factor "N" (FIG. 2-G) is determined in an inter-tooth interval which just precedes the final time-out. It is for this reason that the invention provides for the variable tooth count (six-sixteen teeth) illustrated in FIG. 2-F and includes the fixed four teeth of final processing following the variable tooth-determined, angle domain portion of the dwell period. However, the invention could be practiced in a modified fashion by providing for a variable pre-dwell period, (such as a period of fourteen to twenty-four teeth in place of the fourteen tooth fixed pre-dwell period) followed by an essentially fixed dwell period which varies only within a single tooth, which, in the present example, would include six teeth followed by 10°+delta DEG, as illustrated in FIG. 2-F and -G. However, such a processor would have to have a sufficiently high processing speed to perform the A/D interrupt, table lookup and calculations of the A/D interrupt service routine so as to have determined the coarse delay angle of instruction (3.6) prior to the first tooth to be sensed following the cylinder pulse interrupt (FIG. 2-B); and, this period of time can become relatively small at very high speeds (such as 6,000 RPM) of an engine. Similarly, the time allocable to calculations in spark systems operative in six cylinder engines, eight cylinder engines and two-stroke engines becomes much less, since the spark must be provided more times in each engine revolution, rather than the two sparks required for the four cylinder, four stroke engine of the present example. Therefore, the variable dwell following the fixed dwell is to be preferred in implementing the present invention.

PROGRAM LISTING

Initialization Routine 1.1—Disable interrupts
1.2—Load counter with 1
1.3—Enable time out (ensures spark F/F=0 at start)
1.4—Reset timer latches
1.5—Clear counter (load ZERO)
1.6—Enable interrupts
1.7—Idle loop

Cylinder Pulse Interrupt Service Routine (+10° BTDC)

2.1—Load counter with 70 degrees (measured in teeth)
2.2—Enable tooth count (counter counts down, clocked by teeth)
2.3—Start A/D conversion
2.4—Wait for A/D interrupt

A/D Interrupt Service Routine 3.1—Read M.A.P. value 3.2—Read ROM with M.A.P. and current RPM
3.3—Subtract desired spark advance from 190°
3.4—Divide result by 5 to determine the number of 5° tooth increments, save remainder (called delta DEG)
3.5—Subtract 18 from number of 5° increments
3.6—Store result as coarse delay angle
3.7—Add 10 DEG+delta DEG
3.8—Scale result for greater precision by multiplying by 4096
3.9—Calc time-out angle=(10°+delta DEG) /5
3.10—Store time-out angle
3.11—Wait for time-out interrupt (14 teeth counted)

Time-Out Interrupt Service Routine 4.1—Reset timer latches
4.2—Jump to RPM subroutine if spark done flag is set
4.3—Jump to spark subroutine if speed check done flag is set
4.4—Jump to speed check subroutine if dwell done flag is set (Dwell Subroutine)

5.1—Load counter with coarse delay angle (measured in teeth)
5.2—Enable tooth count (counter counts down, clocked by teeth)
5.3—Set dwell done flag
5.4—Set spark F/F (begins dwell period)
5.5—Wait for time-out interrupt (6–16 teeth counted)

(Check Speed Subroutine)

6.1—Clear counter (load ZERO)
6.2—Enable tooth timer (counter counts up clocked by system clk)
6.3—Clear dwell done flag
6.4—Set speed check done flag
6.5—Wait for time-out interrupt (second tooth, end of speed measurement)

(Spark Subroutine)

7.1—Read counter (system clocks per tooth=N)
7.2—Multiply time-out angle by N
7.3—Rescale for greater precision by multiplying by 16
7.4—Deduct fixed calculation time
7.5—Load counter with result
7.6—Enable time out (count down on system clocks)
7.7—Clear speed check done flag
7.8—Set spark done flag
7.9—Wait for time out interrupt (end dwell; spark F/F is cleared at underflow to fire spark)

(RPM Subroutine)

8.1—Clear spark done flag
8.2—Divide 60 f/T by N to determine present RPM
8.3—Get last RPM
8.4—Get next to last RPM
8.5—Find change 1 (present RPM—last RPM)
8.6—Find change 2 (last RPM—next to last RPM)
8.7—Change 1=0?
8.8—If yes, jump to 8.19
8.9—Change 2=0?
8.10—If yes, jump to 8.19
8.11—Change 1>0?
8.12—If yes, jump to 8.16
8.13—Change 2>0?
8.14—If yes, jump to 8.19
8.15—Jump to 8.18
8.16—Change 2<0?
8.17—If yes, jump to 8.19
8.18—Add change 1 to present RPM
8.19—Store result as current RPM
8.20—Replace next to last RPM with last RPM
8.21—Replace last RPM with present RPM
8.22—Wait for cylinder pulse IRPT (to begin next cycle)

I claim:

1. Electronic spark angle timing apparatus for a spark ignition, internal combustion engine, comprising:

means for providing cylinder signals indicative of the occurrence of each cylinder-related sub-cycle of the engine;

means for providing engine angle signals delineating angular rotation of the engine within each cylinder-related sub-cycle of engine rotation, said engine angle signals indicating angles of rotation which are much smaller than the angles of rotation to each cylinder-related sub-cycle of the engine;

means operative in response to inlet manifold pressure of the engine for providing pressure signals indicative of engine loading; and signal processing means including a source of clock signals and repetitively operative in relation to successive cylinder-related engine sub-cycles in response to said cylinder signals, said engine angle signals and said pressure signals, for providing engine speed-related signals in response to said clock signals and said engine angle signals, for counting a fixed number of said engine angle signals while concurrently, first, providing firing angle signals indicative of the desired spark firing angle as a function of engine speed and load in response to said speed-related signals and said pressure signals, and, second, providing, in response to said firing angle signals, count signals, dependent upon the number of said engine angle signals in excess of said fixed member which are produced within a desired delay angle which extends between the angle at which said cylinder signals appear and a related desired spark firing angle, and remainder signals dependent upon a portion of said desired delay angle in excess of the aggregate angle represented by the number of said engine angle signals indicated by said corresponding count signals, and for counting a number of said engine angle signals produced subsequent to one of said cylinder signals in dependence on said related count signals and for thereafter counting a number of said clock signals determined by related ones of said remainder signals and said speed signals to provide a signal indicating the time of the desired spark firing angle represented by said firing angle signals.

2. Apparatus according to claim 1 in which said processing means provides said speed-related signals in response to said clock signals and said engine angle signals once within each cylinder-related sub-cycle of the engine, provides said spark firing angle relating to one cylinder-related sub-cycle of the engine in response to the speed-related signals provided within an immediately preceding cylinder-related sub-cycle of the engine, and counts a number of said clock signals in each cylinder-related sub-cycle of the engine determined by the speed-related signals provided within that cylinder-related sub-cycle of the engine.

3. Apparatus according to claim 1 wherein said processing means provides said count signals equivalent to less than the full number of said engine angle signals which are produced within said desired delay angle, and counts a number of said clock signals in excess of the number of said clock signals which are equivalent in engine angle to related ones of said remainder signals, whereby the counting of said clock signals includes a portion of said desired delay angle having an angular extent which is greater than the angular extent corresponding to a plurality of said engine angle signals.

4. Apparatus according to claim 3 wherein said processing means counts a number of said clock signals which takes into account a fixed calculation time delay.

* * * * *

UNITED STATES PATENT AND TRADEMARK OFFICE

CERTIFICATE OF CORRECTION

PATENT NO. : 4,273,089

DATED : June 16, 1981

INVENTOR(S) : Thomas A. Maier

It is certified that error appears in the above—identified patent and that said Letters Patent is hereby corrected as shown below:

| | |
|---|---|
| Column 1, line 22 | "vauum" should read --vacuum-- |
| Column 3, line 20 | "preferred" should read --referred-- |
| Column 4, line 21 | "calculated" should read --calculations-- |
| Column 4, line 33 | "(Fig. 2J)" should read --(Fig. 2I)-- |
| Column 8, line 8 | "pre-dewll" should read --pre-dwell-- |
| Column 11, line 10 | "to" should read --of-- |
| Column 14, line 18 | "rotation" should read --rotation related-- |

Signed and Sealed this

*Eighth* Day of *June 1982*

[SEAL]

*Attest:*

*Attesting Officer*

GERALD J. MOSSINGHOFF

*Commissioner of Patents and Trademarks*